US011668186B2

(12) United States Patent
Schulte et al.

(10) Patent No.: US 11,668,186 B2
(45) Date of Patent: Jun. 6, 2023

(54) MODULAR FRACKING BALL ASSEMBLY AND METHOD(S) OF USE THEREOF

(71) Applicant: High Resolution Data, LLC, Centennial, CO (US)

(72) Inventors: William Schulte, Centennial, CO (US); Gary Cook, Monument, CO (US)

( * ) Notice: Subject to any disclaimer, the term of this patent is extended or adjusted under 35 U.S.C. 154(b) by 230 days.

(21) Appl. No.: 17/163,404

(22) Filed: Jan. 30, 2021

(65) Prior Publication Data

US 2021/0238982 A1 Aug. 5, 2021

Related U.S. Application Data

(60) Provisional application No. 62/967,766, filed on Jan. 30, 2020.

(51) Int. Cl.

| | |
|---|---|
| ***E21B 47/06*** | (2012.01) |
| ***E21B 28/00*** | (2006.01) |
| ***E21B 47/26*** | (2012.01) |
| ***E21B 33/12*** | (2006.01) |
| ***E21B 43/26*** | (2006.01) |

(52) U.S. Cl.

CPC ..... *E21B 47/06* (2013.01); *E21B 28/00* (2013.01); *E21B 33/12* (2013.01); *E21B 43/26* (2013.01); *E21B 47/26* (2020.05)

(58) Field of Classification Search

CPC ..... E21B 47/06; E21B 28/00; E21B 47/26

See application file for complete search history.

(56) References Cited

U.S. PATENT DOCUMENTS

| | | | | |
|---|---|---|---|---|
| 9,007,323 | B2 * | 4/2015 | Araki | G06F 3/04883 345/173 |
| 2016/0084075 | A1 | 3/2016 | Ingraham et al. | |
| 2017/0335644 | A1 | 11/2017 | Ciezobka | |
| 2017/0335678 | A1 * | 11/2017 | Ciezobka | E21B 47/07 |
| 2019/0316459 | A1 * | 10/2019 | Chen | E21B 33/12 |
| 2022/0184463 | A1 * | 6/2022 | Ganson | G06F 3/0346 |

* cited by examiner

*Primary Examiner* — Catherine Loikith

(74) *Attorney, Agent, or Firm* — Leyendecker & Lemire, LLC

(57) ABSTRACT

Embodiments of the modular fracking ball assembly can include, but are not limited to, a measurement assembly, a shock absorbing layer, and an outer shell. The shock absorbing layer can encase the measurement assembly and the outer shell can encase the shock absorbing layer and the measurement assembly. The outer shell of the modular fracking ball assembly can be replaced with another outer shell when a change in parameters of the modular fracking ball assembly is needed. For instance, an overall diameter or a specific gravity of the modular fracking ball assembly can be changed by swapping outer shells.

20 Claims, 5 Drawing Sheets

MODULAR FRACKING BALL ASSEMBLY AND METHOD(S) OF USE THEREOF

CROSS-REFERENCE TO RELATED APPLICATION

This application claims the benefit of U.S. Provisional Application No. 62/967,766, filed Jan. 30, 2020.

BACKGROUND

Frac balls are known to be implemented for isolating a section of a wellbore by plugging an opening in a frac plug. Currently available frac balls include a generally spherical construction and are made of various materials capable of withstanding high temperatures and pressures encountered in fracking operations. However, frac balls are generally not smart and are solely used to plug an opening. Smart frac balls are known, but they are limited in their ability to be used in a wide variety of fracking operations.

Currently, methods used to acquire downhole pressure and temperature data are either prohibitively expensive or inadequate. Further, known smart frac balls are prohibitively expensive as each frac ball must be manufactured for a specific bore size. This can lead to great expense for an operation that has differently sized bores.

A smart fracking ball that can measure downhole conditions and be modular for use in a variety of differently sized bores is needed.

DETAILED DESCRIPTION

Figure 1B:
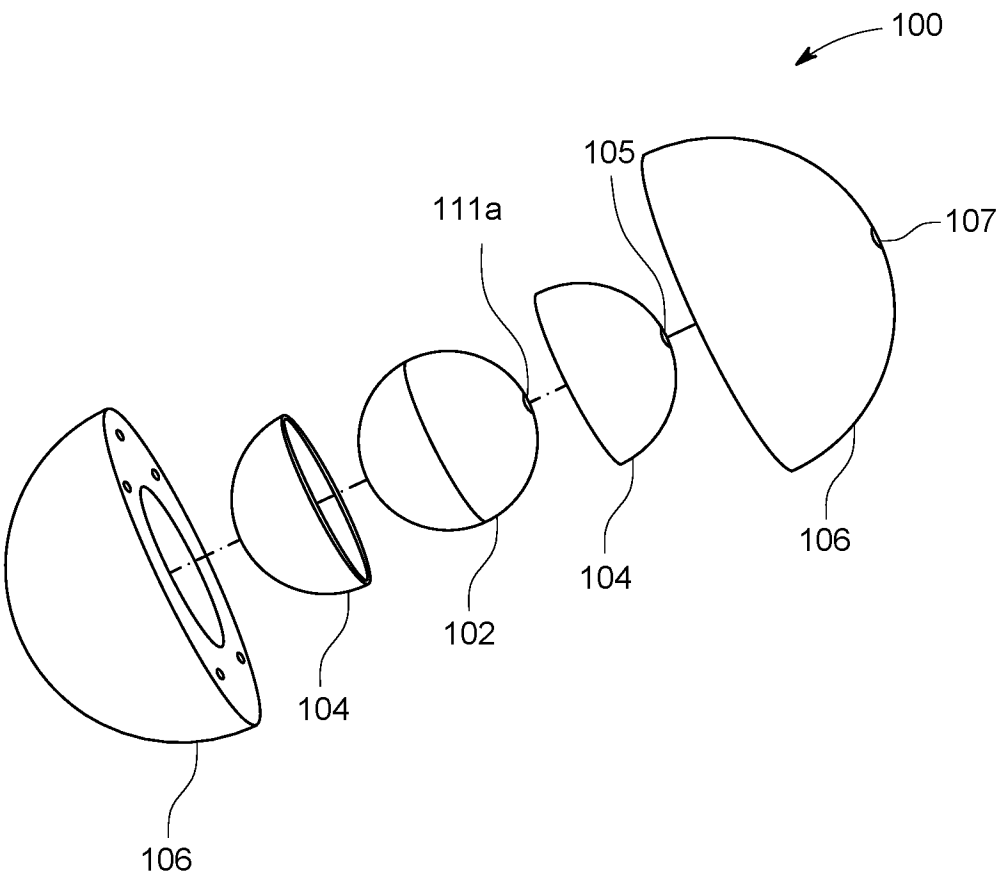
FIG. 1B is an exploded view of a modular fracking ball assembly according to one embodiment of the present invention.

Embodiments of the present invention include a modular fracking ball assembly. In some instances, a plurality of modular fracking ball assemblies can be implemented at an oil/gas well. In such an embodiment, one or more of the modular fracking ball assemblies may have different diameters and/or specific gravities. Of note, the modular fracking ball assembly can be implemented to replace currently available fracking balls of most sizes and provide a means for measuring pressure and temperature in a well. The modular fracking ball assembly can include a removable outer shell that may be swapped with other outer shells having differing diameters and/or specific gravities. As can be appreciated, the modularity of the modular fracking ball assembly provided by the removable outer shell can allow an operator the ability to change features of the modular fracking ball assembly on a job site.

In one embodiment, the modular fracking ball assembly can include, but is not limited to, a measurement assembly, a shock absorbing layer, and an outer shell. The measurement assembly can include a pressure sensor and/or a temperature sensor for measuring pressure and temperature. It is to be appreciated that the measurement assembly can be outfitted with a variety of different sensors based on a need of a particular fracking operation. The shock absorbing layer can be implemented to provide protection for the sensor of the measurement assembly. The outer shell can be implemented to provide protection along with modularity by being removable and allowing different sized outer shells to be used with the measurement assembly. In some embodiments, the outer shell can be designed to include means for orienting the measurement assembly in a well such that the sensor is in a position to take measurements. For instance, the outer shell may have channels that are configured to orient the modular fracking ball assembly while being flowed into the well in a fluid. In another instance, the modular fracking ball assembly may be weighted such that the sensor is oriented properly when suspended in a fluid.

Of significant note, a bottom hole measurement is difficult to obtain with traditional methods and is very expensive. Further, fracking operations typically employ a plurality of stages in the well. Obtaining measurements for each stage in the fracking operation can increase the costs. A plurality of modular fracking ball assemblies can be implemented to take measurements at each stage of the fracking operation in the well and provide an economical solution to currently available methods. Embodiments of the modular fracking ball assembly can be an economical means for measuring and storing pressure and/or temperature data in a well.

In one embodiment, the measurement assembly can be a lightweight, thin walled, hollow ball shaped data recorder adapted to measure and record pressure and/or temperature data. In one instance, the measurement assembly can be capable of withstanding extreme pressures of up to 20,000 psi. The measurement assembly can be implemented to replace traditional sealing frack balls and can be used for their ability to be flowed back after they measure and record data. In a typical implementation, the measurement assembly can be deployed at the surface of an oil/gas well and may be carried or pumped into the well and measurements may then be collected deep in the well. Once the measurement time period is achieved, the measurement assembly can be designed to be flowed out of the well using the produced oil or gas flowing production stream. The modular fracking ball assembly can be used in conjunction with frac ball conveyance and retrieval systems. For example, the EVOLV®+ FracTrap™ made by GEODYNAMICS®. U.S. Pat. Nos. 9,617,816, 9,464,499, 9,765,590 and related patent applications are hereby incorporated by reference in their entirety.

A nonvolatile storage inside the measurement assembly may then be removed and data can be retrieved from the nonvolatile storage. The measurement assembly can include the sensor(s) and the nonvolatile storage, housed in a small high-pressure resistant shell, to accurately take and store measurements in a downhole well environment. Of note, because of a weld sealed construction, unique operational methods can be employed in the design and use of the modular fracking ball assembly.

Different pipe sizes and flow back production rates in fracking operations requires a useful way to have a variety of diameters and weights of frack balls. Typically, an outer shell of the measurement assembly can be provided to enhance a flowback of the measurement assembly and/or to meet other specific sizing requirements. Outer shells can be manufactured that have differing outside diameters and specific gravities. The outer shell can also be included to provide protection to the measurement assembly. Typically, fracking balls are subject to "cut out" from high-pressure and high-velocity sand and water slurries encountered in the well during fracking operations. A water jet erosion cutting effect can be created by the slurries, thus the outer shell can be implemented to provide protection. Of significant note, the modular fracking ball assembly can be designed to be implemented in more than one well operation. For instance, a measurement assembly can be outfitted with a shock absorbing layer and outer shell for use in a first well operation. After the modular fracking ball assembly has been flowed back and retrieved, the measurement assembly of the modular fracking ball assembly may be needed for a second well operation. If the outer shell and/or shock absorbing layer have been damaged beyond use, the components may be replaced such that the measurement assembly is ready for use in the second well operation. As can be appreciated, this can cut down on costs as a singular measurement assembly, in combination with one or more shock absorbing layers and outer shells, can be implemented in multiple well operations before data may be retrieved from the measurement assembly.

Manufacturing a larger diameter hollow shell requires more material and a weight of the shell increases substantially. Frack balls are generally sized by diameter and also specific gravity. The larger sizes must have thicker walls and become heavier until a specific gravity is difficult to achieve. The need to maintain the extreme pressure ratings requires thicker walls to withstand the crushing force encountered in fracking operations. To overcome the weight-to-volume issue, the shell of the measurement assembly can be relatively small and lightweight. An outer shell having a larger outside diameter can be manufactured from a lower density material. In one instance, the pressure rating of the measurement assembly can be adapted to withstand extreme pressure forces while the outer layer can be made of a solid low-density material. Of note, the outer shell does not have the extreme differential pressure requirements of the hollow measurement assembly. In one embodiment, the outer shell can be formed around the measurement assembly. Of note, one of a plurality of construction methods (e.g., injection molding the outer shell around the measurement assembly or coupling two half spheres around the measurement assembly) can be implemented. The outer shell can be ported (e.g., include a port) to allow the measurement assembly to directly sense pressure.

The downhole well environment in fracking operations requires a data recorder to be able to withstand high shock forces. As such, embodiments of the modular fracking ball assembly can include the shock absorbing layer between the outer shell and the measurement assembly. Of note, by implementing a shell design as described above with an additional layer of shock absorbing materials (e.g., rubber like material) to cradle the measurement assembly, the shock absorbing layer can help protect the pressure sensor from the high shock forces encountered in downhole well environments. It is to be appreciated that other means and methods of providing shock resistance for the pressure sensor are contemplated and not outside a scope of the present invention.

Frack plug openings can obstruct traditional sealing frack balls from being retrieved. Currently, high strength materials are available which dissolve in a well over time. In some embodiments, the measurement assembly can be enclosed in a dissolvable material. For instance, the outer shell can be manufactured from a dissolvable material. Once in the well, the outer shell can dissolve and the measurement assembly can pass through the plug openings and flow to the surface. In some instances, the outer shell can be manufactured such that only a portion of an exterior of the outer shell dissolves thus reducing an outer diameter of the modular fracking ball assembly while still providing protection. For example, the outer shell may be layered with different materials with a dissolvable material as an exterior layer that may dissolve over time.

In some embodiments, the outer shell may include grooves and/or weighting to position the modular fracking ball assembly. Of note, a pressure port of the measurement assembly should be orientated correctly when the modular fracking ball assembly is used as a plug sealing ball. Since there is only one port available, a method to increase the probability is needed. In one embodiment, the outer shell can be made with grooving to provide a flowing fluid (e.g., liquid or gas) to help orient the measurement assembly position. In another instance, a preferentially weighted side of the outer shell (or measurement assembly) can be used to increase the probability of the pressure port in the desired position. Either separately or together, these methods can be implemented to increase a probability of sensing the desired pressure.

Along with specific gravity adjustment described earlier, modifying a surface friction of the modular fracking ball assembly can help the modular fracking ball assembly flow back to surface especially with lower flowback production rates. The outer shell method can be used and then dimpling, as in a golf ball, or a roughed-up surface can be added to the outer shell.

In some instances, the modular fracking ball assembly can be implemented in a shut-in well. For instance, the modular fracking ball assembly can be dropped into a shut-in well (e.g., non-flowing, capped, or non-producing well). The modular fracking ball assembly can record measurements for a period of time while the well is shut-in. The well could then be to returned to production causing the modular fracking ball assembly to flow back and be retrieved at a wellhead. Due to the variability of flowback rates in different wells, the modular fracking ball assembly can be optimized for flowback at a particular well based on a specific gravity of the modular fracking ball assembly. As such, an operator can select an outer shell for the modular fracking ball assembly based on a needed specific gravity to enhance the probability of the modular fracking ball assembly flowing back based on the conditions in the well.

In other instances, the modular fracking ball assembly can be implemented for pressure testing an integrity of a pipeline. Since pipelines can have varying sized interior diameters, the modular fracking ball assembly can be assembled to a particular size based on the interior diameter of the pipeline being tested. Typically, the modular fracking ball assembly, after being correctly sized by selecting an outer shell with an appropriate diameter, can be inserted into the pipeline and configured to record time and pressure for signs of leak off. Of note, multiple valve isolated pipe intervals can be tested while the ball moves down the pipeline. A singular measurement assembly in combination with a variety of differently sized outer shells can be implemented to test a variety of differently sized pipes. As can be appreciated, this can lower an overall cost as a singular measurement assembly can be repeatedly used.

Since the electronic components of the measurement assembly are in a weld sealed enclosure, a means for allowing an operator to "turn on" the electrical components along with receiving feedback that the electrical components were successfully turned on is required. In one embodiment, a control module of the measurement assembly can be battery operated and can be configured for low power consumption and sufficient data storage. The control module can be manufactured, tested, calibrated, and then sealed inside the measurement assembly in a powered off condition. In order for the operator to begin recording data at a later date, a means for turning on the control module is needed. In one embodiment, a magnetically activated switch can be implemented. In some embodiments, the shell of the measurement assembly can be manufactured from a non-magnetic material (e.g., titanium). Since the titanium metal shell of the measurement assembly may be non-magnetic, a magnetic field can pass easily into the enclosed switch and signal a microprocessor of the control module to begin receiving and recording data.

As can be appreciated, the operator may need to know the control module turned on successfully. A haptic feedback micro-motor vibrator can be activated and felt by the operator when a magnet is brought in close proximity to the switch. Of note, sequencing the vibration from the motor can also send messages to the operator for other condition codes.

In some embodiments, the titanium shell of the measurement assembly can be cut open in order to retrieve stored data from the weld sealed control module. A special utility device to hold the ball in place while using a cutting wheel (e.g., a device similar to a standard pipe cutter) can be implemented, especially for portable oil field use.

Embodiments of the present invention can be implemented for a plurality of different uses. For instance, pressure measurements recorded by the measurement assembly can be implemented to calibrate fluid flows during fracture operations. In another instance, accurate bottom hole pressures can be recorded and analyzed with unknown pumped fracture slurries. In yet another instance, pressure measurements recorded by the measurement assembly can be implemented to calibrate frack fluids during, and while using, a variety of flow rates and fluid solutions. Of note, the modular fracking ball assemblies can be implemented to obtain information for ensuring optimum fracking success. Further, pressure measurements recorded simultaneously in adjacent wells and stages permit analysis and evaluation of interference/damage effects at depth.

Embodiments of the present invention can further include a modular fracking ball system. The modular fracking ball system can include a plurality of measurement assemblies, a plurality of shock absorbing layers, and a plurality of outer shells. The plurality of measurement assemblies can typically be substantially similar and may include variances in the types of sensors employed. For instance, one or more of the plurality of measurement assemblies can include pressure sensors, one or more may include temperature sensors, and one or more may include pressure and temperature sensors. It is to be appreciated that other types of sensors can be implemented. The plurality of outer shells can include shells having differing diameters and specific gravities. The plurality of shock absorbing layers can include various different materials determined based on a need of a particular well. In one instance, the outer shells can be configured to be removably coupled to one of the measurement assemblies. As can be appreciated, an operator at a well can pair the measurement assemblies with outer shells based on specific needs for the well. In some instances, the outer shells may be more permanently coupled to the measurement assemblies. For example, an adhesive can be implemented to adhere the outer shell together with the measurement assembly encased therein.

Embodiments of the modular fracking ball assemblies can be implemented similar to currently available fracking balls. However, the modular fracking ball assemblies include a means for measuring conditions inside a well and storing data related to the conditions. Once the modular fracking ball assembly has been removed from the well, the data can be retrieved and used for various purposes. In one example, the modular fracking ball assembly may include a pressure sensor for measuring pressure inside a well. In another example, the modular fracking ball system can include modular fracking ball assemblies with different sensors (e.g., one or more with pressure sensors and one or more with temperature sensors).

In one embodiment, a modular fracking ball assembly can include, but is not limited to, a measurement assembly and an outer shell. The measurement assembly can include, but is not limited to, a shell, a pressure sensor, a control module, a vibratory motor, and a switch. The shell can have a substantially spherical shape with a first hemisphere welded to a second hemisphere. The pressure sensor can be located inside the shell and adapted to measure one or more well environment conditions. The control module can be located inside the shell and can be adapted to store measurements from the pressure sensor. The vibratory motor can be located inside the shell and can be adapted to provide haptic feedback to a user. The switch can be located inside the shell and can be adapted to turn the control module on and off. The outer shell can encase the measurement assembly.

In another embodiment, a modular fracking ball assembly can include, but is not limited to, a measurement assembly, a shock absorbing layer, and an outer shell. The measurement assembly can include, but is not limited to, a non-magnetic shell, a pressure sensor, a control module, a vibratory motor, and a switch. In one instance, the non-magnetic shell can have a spherical shape formed from two hemispheres coupled together via an electron beam welding process. In another instance, the non-magnetic shell can have a spherical shape formed from two hemispheres coupled together via threads. For instance, a first hemisphere can have female threads configured to threadably couple to male threads of the second hemisphere. The pressure sensor can be located inside the shell and adapted to measure one or more well environment conditions. The control module can be located inside the shell and can be adapted to store measurements from the pressure sensor. The vibratory motor can be located inside the shell and can be adapted to provide haptic feedback to a user. The switch can be located inside the shell and can be adapted to turn the control module on and off. The shock absorbing layer can surround the measurement assembly. The outer shell can encase the shock absorbing layer and the measurement assembly.

In one embodiment, a method of implementing at least one modular fracking ball assembly can include, but is not limited, the following steps. First, at least one modular fracking ball assembly in a powered down state can be provided. The modular fracking ball assembly can include, but is not limited to, an outer shell, a shock absorbing layer, and a measurement assembly. The measurement assembly can include, but is not limited to, a shell having a substantially spherical shape with a first hemisphere welded to a second hemisphere, a pressure sensor located inside the shell, a control module located inside the shell and adapted to store measurements from the pressure sensor, a vibratory motor located inside the shell and adapted to provide haptic feedback, and a switch located inside the shell and adapted to turn the control module on and off. Second, the control module can be turned on by activating the reed switch with a magnet located exterior to the modular fracking ball assembly. Third, haptic feedback can be received by a user from the vibratory motor indicating that the control module has been turned on. Fourth, the modular fracking ball assembly can be prepared for use in a well operation.

In another embodiment, a method of implementing a plurality of modular fracking ball assemblies can include, but is not limited to, the following steps: first, a plurality of measurement assemblies can be provided; second, a plurality of shock absorbing layers can be provided where each of the shock absorbing layers can be adapted to encase one of the measurement assemblies; third, a plurality of outer shells can be provided where each of the outer shells can be adapted to encase one of the shock absorbing layers and measurement assemblies; fourth, a first modular fracking ball assembly can be assembled; fifth, the control module can be turned on by activating the reed switch with a magnet located exterior to the modular fracking ball assembly; sixth, haptic feedback can be received by a user from the vibratory motor indicating that the control module has been turned on; and seventh, the assembled modular fracking ball assembly can be prepared for use in a well operation. The step of assembling the modular fracking ball assembly can include, but is not limited to, selecting (i) one of the plurality of measurement assemblies, (ii) one of the plurality of shock absorbing layers, and (iii) one of the plurality of outer shells and then encasing the measurement assembly with the shock absorbing layer and the outer shell. One of the plurality of outer shells can be selected based on a desired specific gravity or a desired outside diameter for the modular fracking ball assembly. Each of the measurement assemblies can include, but are not limited to, a shell having a substantially spherical shape with a first hemisphere welded to a second hemisphere, a pressure sensor located inside the shell, a control module located inside the shell and adapted to store measurements from the pressure sensor, a vibratory motor located inside the shell and adapted to provide haptic feedback, and a switch located inside the shell and adapted to turn the control module on and off.

The present invention can be embodied as devices, systems, methods, and/or computer program products. Accordingly, the present invention can be embodied in hardware and/or in software (including firmware, resident software, micro-code, etc.). Furthermore, the present invention can take the form of a computer program product on a computer-usable or computer-readable storage medium having computer-usable or computer-readable program code embodied in the medium for use by or in connection with an instruction execution system. In one embodiment, the present invention can be embodied as non-transitory computer-readable media. In the context of this document, a computer-usable or computer-readable medium can include, but is not limited to, any medium that can contain, store, communicate, propagate, or transport the program for use by or in connection with the instruction execution system, apparatus, or device.

The computer-usable or computer-readable medium can be, but is not limited to, an electronic, magnetic, optical, electromagnetic, infrared, or semiconductor system, apparatus, device, or propagation medium.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "software," as used in this specification and the appended claims, refers to programs, procedures, rules, instructions, and any associated documentation pertaining to the operation of a system.

The term "firmware," as used in this specification and the appended claims, refers to computer programs, procedures, rules, instructions, and any associated documentation contained permanently in a hardware device and can also be flashware.

The term "hardware," as used in this specification and the appended claims, refers to the physical, electrical, and mechanical parts of a system.

The terms "computer-usable medium" or "computer-readable medium," as used in this specification and the appended claims, refers to any medium that can contain, store, communicate, propagate, or transport the program for use by or in connection with the instruction execution system, apparatus, or device. The computer-usable or computer-readable medium may be, for example but not limited to, an electronic, magnetic, optical, electromagnetic, infrared, or semiconductor system, apparatus, device, or propagation medium. By way of example, and not limitation, computer readable media may comprise computer storage media and communication media.

The term "signal," as used in this specification and the appended claims, refers to a signal that has one or more of its characteristics set or changed in such a manner as to encode information in the signal. It is to be appreciated that wireless means of sending signals can be implemented including, but not limited to, Bluetooth, Wi-Fi, acoustic, RF, infrared and other wireless means.

An Embodiment of a Modular Fracking Ball Assembly

Figure 1A:
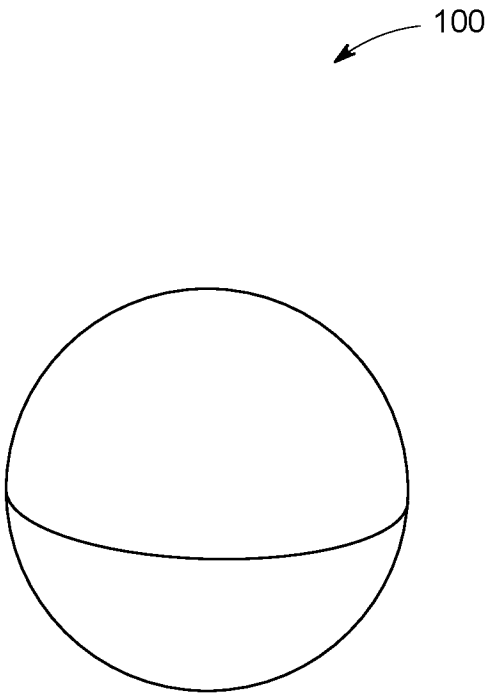
FIG. 1A is a perspective view of a modular fracking ball assembly according to one embodiment of the present invention.

Referring to FIGS. 1A-1B, detailed diagrams of an embodiment 100 of a modular fracking ball assembly are illustrated. The modular fracking ball assembly 100 can be implemented in place of currently available fracking balls. Typically, the modular fracking ball assembly 100 can be implemented in the oil and gas industry, and more specifically, in fracking operations.

Figure 5:
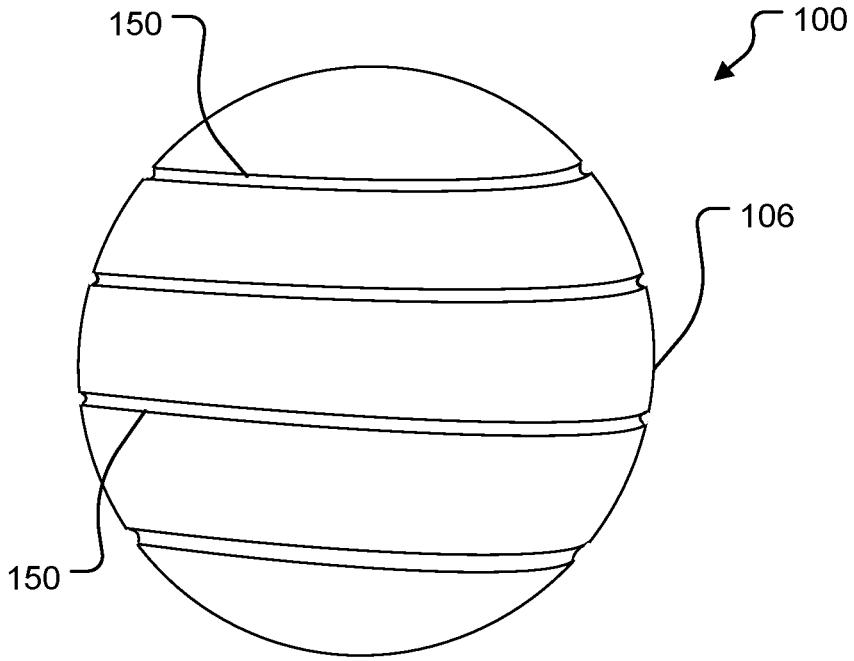
FIG. 5 is a perspective view of a modular fracking ball assembly having grooves according to one embodiment of the present invention.

Referring to FIG. 1A, a perspective view of the modular fracking ball assembly 100 is illustrated. Referring to FIG. 1B, an exploded view of the modular fracking ball assembly 100 is illustrated. As shown in FIG. 1A, the modular fracking ball assembly 100 can have a substantially spherical shape. In some embodiments, an outer surface of the modular fracking ball assembly 100 can include grooves, channels, etc. to help orient the modular fracking ball assembly 100 in a well, as shown in FIG. 5.

As shown in FIG. 1B, the modular fracking ball assembly 100 can include, but is not limited to, a measurement assembly 102, a shock absorbing layer 104, and an outer shell 106. Of note, the measurement assembly 102 may be implemented by itself in some instances. For instance, the measurement assembly 102 may be implemented as a fracking ball configured to seal a frac plug. In some embodiments, the modular fracking ball assembly 100 can consist essentially of the measurement assembly 102 and the outer shell 106.

The modular fracking ball assembly 100 can be implemented to take measurements in a downhole well environment. The measurement assembly 102 can typically include a pressure sensor and/or a temperature sensor for measuring pressure and temperature in a well. Of note, the measurement assembly 102 can be outfitted with one of a variety of different sensors based on a need of a particular fracking operation. The shock absorbing layer 104 can be located between the measurement assembly 102 and the outer shell 106. Of note, by implementing a shell design as described with the shock absorbing layer 104 (e.g., a rubber like material) to cradle the measurement assembly 102, the shock absorbing layer 104 can help protect a sensor of the measurement assembly 102. In one example, the shock absorbing layer 104 can be integrated into the outer shell 106. The outer shell 106 can be implemented to provide (i) protection to the measurement assembly 102, (ii) variance in a diameter of the modular fracking ball assembly 100, (iii) variance in a specific gravity of the modular fracking ball assembly 100, and (iv) a means for orienting the modular fracking ball assembly 100 inside a well plug.

A modularity of the modular fracking ball assembly 100 can be obtained by a combination of the measurement assembly 102 and the outer shell 106. As shown in FIG. 1B, the outer shell 106 can include a cavity configured to receive the shock absorbing layer 104 and the measurement assembly 102 therein. A variety of different outer shells having varying diameters, material properties, specific gravities, and functionalities can be implemented with the modular fracking ball assembly 100. For instance, an operator at a fracking site may determine that an outer shell having a first specific gravity may be more applicable for the fracking site than a different outer shell with a second specific gravity. The operator may then outfit each of the measurement assemblies 102 with the outer shell 106 selected by the operator. For example, the outer shells may be manufactured from different materials providing varying specific gravities. In another instance, the operator may determine that a plurality of differently sized modular fracking ball assemblies 100 are needed and each measurement assembly 102 may be outfitted with an outer shell having a different diameter. In such an instance, each of the modular fracking ball assemblies 100 can effectively have a different diameter.

Typically, the shock absorbing layer 104 can have high temperature and chemical resistant characteristics that are good for oil and gas well fluids. For instance, synthetic rubbers, fluoropolymer elastomers, fluoroelastomers, synthetic elastomers, etc. can be implemented. In one example, the shock absorbing layer 104 can be a Viton® rubber with a mid-range durometer of 60A. Typically, the shock absorbing layer 104 can be molded to the measurement assembly 102. In some instances, the shock absorbing layer 104 may be fitted to the measurement assembly 102 after being formed.

The outer shell 106 can be manufactured from, but is not limited to, hybrid composites, metal composites, metals, glass-reinforced epoxy resins, and/or thermoplastics. In some instances, depending on the material, the outer shell 106 may be molded to the shock absorbing layer 104 and the measurement assembly 102. In other instances, the outer shell 106 can include two halves that may be removably coupled to one another and adapted to encase the shock absorbing layer 104 and the measurement assembly 102. For example, the two halves of the outer shell 106 may be threadably coupled to one another. In another example, the outer shell 106 may implement protrusions and receptacles. The receptacles may be adapted to frictionally engage the protrusions to couple to one another. As shown in FIG. 1B, the outer shell 106 can include a cavity sized to receive the shock absorbing layer 104 and the measurement assembly 102 therein.

In one embodiment, the outer shell 106 can be a molded composite material. In another embodiment, the outer shell 106 may be manufactured from a material designed to be dissolved over time in a well environment (e.g., when interacting with a high pressure and high temperature environment). For example, a magnesium alloy or composite can be implemented as a dissolvable shell. A dissolvable outer shell can provide protection for the measurement assembly 102 and allow for a smaller diameter modular fracking ball assembly 100 to be flowed out of a well through tubing, plugs, and other restrictions. As can be appreciated, as the modular fracking ball assembly 100 remains in a well, the dissolvable shell can decrease a diameter of the modular fracking ball assembly 100, allow the modular fracking ball assembly to pass through plugs previously not passable.

Figure 2:
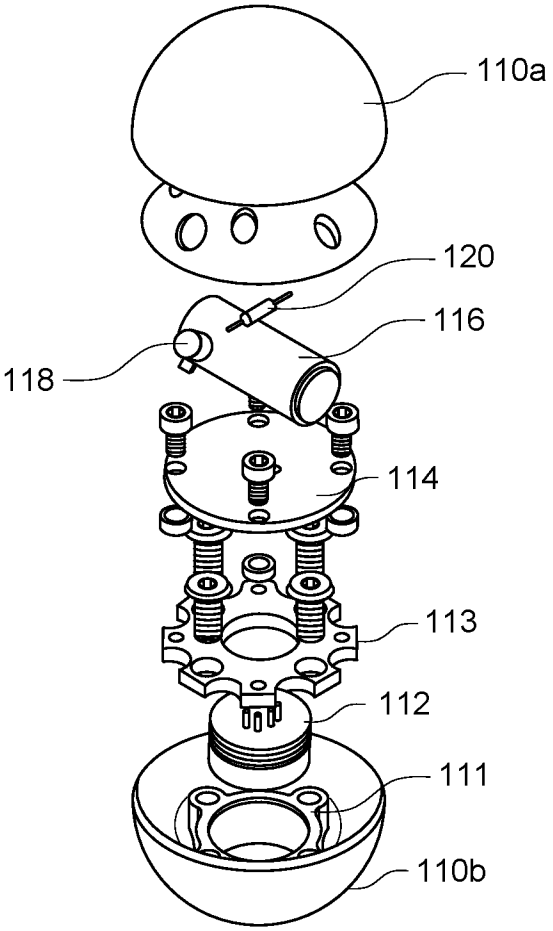
FIG. 2 is an exploded view of a measurement assembly according to one embodiment of the present invention.

Referring to FIG. 2, an exploded view of the measurement assembly 102 is illustrated. Of note, components listed in FIG. 2 are for one example embodiment of the measurement assembly 102 and are not meant to be limiting. For instance, embodiments are contemplated with more or less of the components illustrated. In one example, a temperature sensor can be implemented. In another example, a pressure and temperature sensor can be implemented.

As shown, the measurement assembly 102 can include, but is not limited to, a shell 110, a sensor 112, a control module 114, a power source (e.g., a battery) 116, a vibratory motor 118, and a switch 120.

In one embodiment, the shell 110 can include an upper (or first) hemisphere 110*a* and a lower (or second) hemisphere 110*b*. The upper hemisphere 110*a* and the lower hemisphere 110*b* can be coupled together with the aforementioned components inside. In one instance, the upper hemisphere 110*a* can be welded to the lower hemisphere 110*b*. For example, an electron beam welding process can be implemented to couple the upper hemisphere 110*a* to the lower half 110*b* to form the shell 110. In another example, the upper hemisphere 110*a* can be threadably coupled to the lower half 110*b*. A gasket or other seal can be implemented where the hemispheres 110*a*, 110*b* are threadably coupled together to help ensure moisture does not enter an interior of the shell 110.

The lower hemisphere 110*b* can include an integrated receptacle 111 configured to receive the sensor 112 therein. For instance, the receptacle 111 can be manufactured as part of the lower hemisphere 110*b*. In some embodiments, the receptacle 111 may include a shock absorbing layer to help reduce shock forces to the sensor 112. The receptacle 111 can further include one or more apertures for receiving threaded member(s) therein to couple a retaining plate 113 to the receptacle 111 for securing the sensor 112 in the receptacle 111. The retaining plate 113 can include one or more apertures for receiving a threaded member therein to secure the control module 114 in place. The sensor 112, the control module 114, the battery 116, the vibratory motor 118, and the switch 120 can be located inside the shell 110.

In one embodiment, the sensor 112 can be a pressure sensor. The pressure sensor 112 can be implemented to measure pressure inside a well where the modular fracking ball assembly 100 may be located. In one instance, the pressure sensor 112 can be a transducer configured to measure pressure. The pressure sensor 112 can be powered by the battery 116 and can be operatively connected to the control module 114. The pressure sensor 112 can be configured to send a signal to the control module 114 to be recorded and stored for later retrieval and analysis. In another embodiment, the sensor 112 can be a temperature sensor. In yet another embodiment, the measurement assembly 102 can include a pressure sensor and a temperature sensor.

Figure 3:
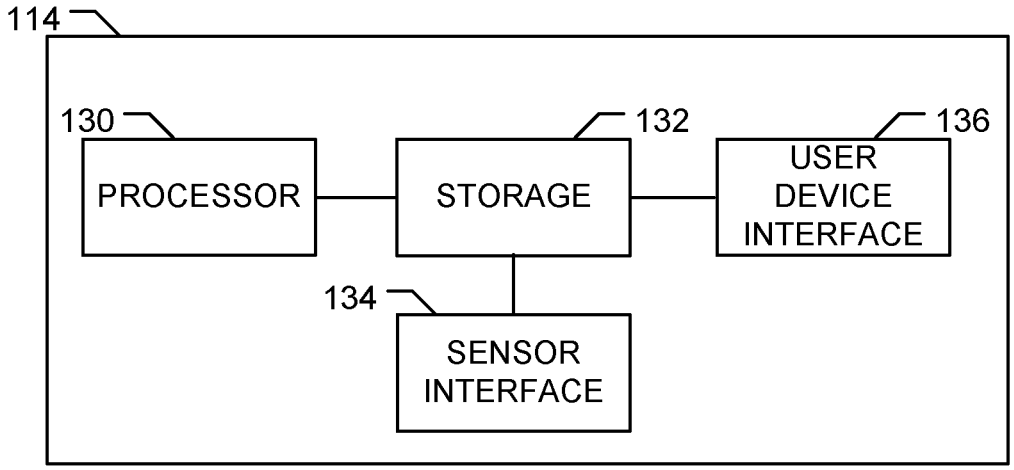
FIG. 3 is a block diagram of a control module according to one embodiment of the present invention

Referring to FIG. 3, a block diagram of the control module 114 is illustrated. As shown, the control module 114 can include, but is not limited to, a processor 130, nonvolatile storage 132, a first interface 134, and a second interface 136. The first interface 134 can be implemented to operatively connect to the pressure sensor 112 and the second interface 136 can be implemented to interface to a user device. In some embodiments, the control module 114 can further include a means for keeping time. Generally, an extremely accurate time-keeping means can be employed.

The battery 116 can be implemented to provide power to at least the sensor 112, the control module 114, and the vibratory motor 118.

Since the components of the measurement assembly 102 are encased in the shell 110, a way to provide feedback to an operator is needed. In one embodiment, the vibratory motor 118 can be implemented to provide haptic feedback to an operator. The vibratory motor 118 can typically be placed proximate an interior wall of the shell 110 to allow vibrations to be felt outside the shell 110.

The shell 110 can typically be manufactured from a rigid material adapted to withstand harsh environments and high pressure. In one example, the shell 110 can be manufactured from a titanium alloy capable of withstanding extreme pressures up to 20,000 psi. As previously mentioned, the components of the measurement assembly 102 can be placed inside the shell 110 and then the two hemispheres 110*a*, 110*b* of the shell 110 can be welded together. In one instance, an electron beam welding process can be implemented to couple the upper hemisphere 110*a* to the lower hemisphere 110*b*. When data is needed to be recovered from the measurement assembly 102, the shell 110 can be cut open to retrieve the control module 114 and data stored therein.

In one embodiment, the switch 120 can be a reed switch that may be operated via a magnetic field. In a typical implementation, the control module 114 can be tested to make sure the control module 114 is working and then can be sealed in the shell 110 in a powered down state (or an "Off" condition). The reed switch 120 can be implemented to turn the control module 114 to a powered-on state (or an "On" condition) such that data can be recorded and stored. When the control module 114 is powered on, the control module 114 can be configured to power on other components.

To turn the control module 114 on, a magnet can be placed proximate the shell 110 of the measurement assembly 102 to operate the reed switch 120 and turn the control module 114 on. Of note, an operator can easily perform this task in the field. To provide a notification to the operator that the control module 114 has been turned on, the vibratory motor 118 can provide haptic feedback to the operator to let them know that the control module 114 has been turned on. For instance, the control module 114 can include coding such that when the control module 114 is turned on, a signal may be sent to the vibratory motor 118 to activate. In some instances, sequencing of the vibration via the vibratory motor 118 can be implemented to send messages to the operator from the control module 114. For example, vibratory sequencing can be stored on the control module 114 before being placed in the shell 110.

Figure 4A:
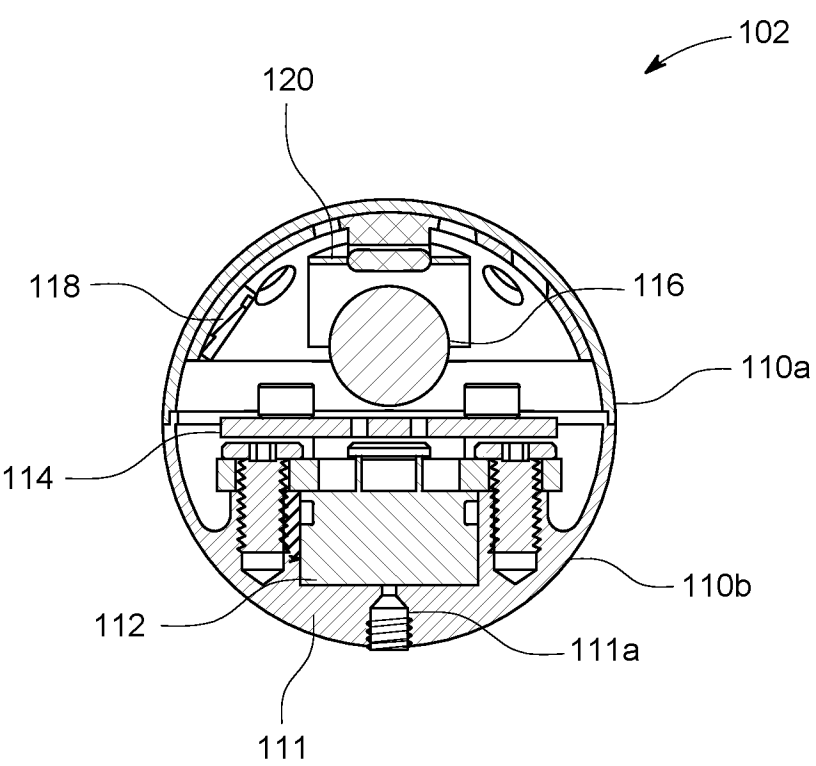
FIG. 4A is a cross-sectional view of a measurement assembly according to one embodiment of the present invention.
Figure 4B:
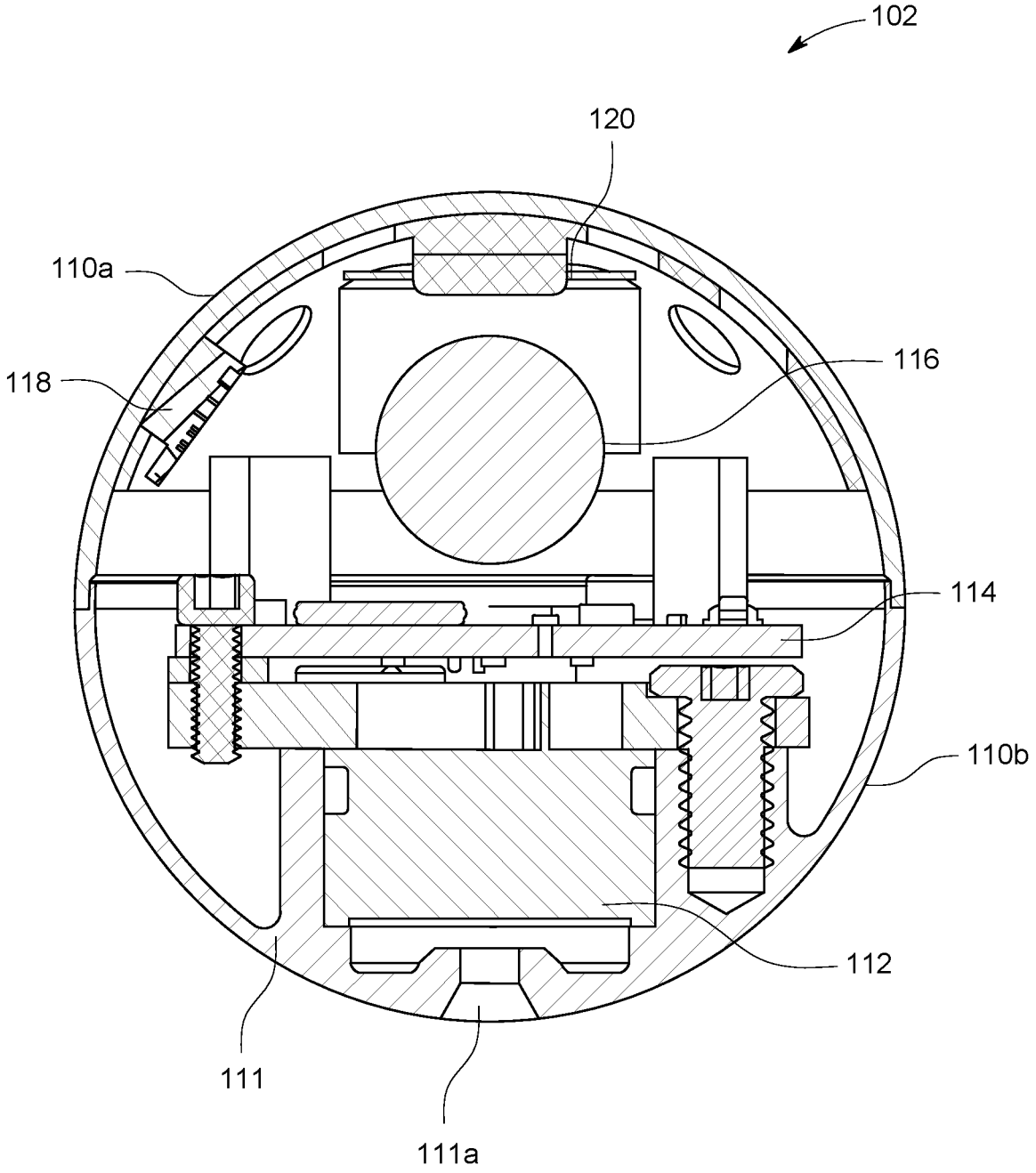
FIG. 4B is a cross-sectional view of a measurement assembly according to one embodiment of the present invention.

Referring to FIGS. 4A-4B, cross-sectional views of example embodiments of the measurement assembly 102 are illustrated. FIG. 4A includes an example measurement assembly 102 having a threaded port. FIG. 4B includes an example measurement assembly 102 having a non-threaded port. As shown generally in FIGS. 4A-4B, the sensor 112, the control module 114, the power source 116, the vibratory motor 118, and the switch 120 can be located in an interior of the shell 110 of the measurement assembly 102. As previously mentioned, an electron beam welding process can be implemented to weld the first hemisphere 110*a* to the second hemisphere 110*b*. Of note, the electron beam welding process can be implemented to ensure that no interior components are damaged when coupling the first hemisphere 110*a* to the second hemisphere 110*b*.

The shell 110 may be ported to provide fluid communication to the sensor 112. A port 111*a* can typically be located in the second hemisphere 110*b* of the shell 110. As shown in FIG. 1, the shock absorbing layer 104 can include a port 105 and the outer shell 106 can include a port 107. As can be appreciated, the sensor 112 can be in fluid communication with an environment even when encased by the shock absorbing layer 104 and the outer shell 106. For example, the ports 105, 107, 111*a* can provide fluid communication to the sensor 112 for the modular fracking ball assembly 100. As shown in FIG. 4A, the port 111*a* may be threaded. As shown in FIG. 4B, the port 111*a* may be non-threaded. In some embodiments, the means for calibrating the sensor 112 can dictate whether the port 111*a* is threaded.

Of note, when the modular fracking ball assembly 100 may be assembled, the ports 105, 107, 111*a* need to be aligned to allow for fluid communication of the sensor 112 with a well environment. In one instance, alignment of the ports 105, 107, 111*a* can be achieved via a guide rod (or tube) that can be removed once assembled. For example, where the port 111*a* is threaded, a threaded rigid tube configured to threadably couple to the port 111*a* may be implemented. In another example, the rigid tube may frictionally engage the port 111*a*. In instances where the shock absorbing layer 104 and the outer shell 106 are molded to the measurement assembly 102, a piece of tubing from the measurement assembly port 111*a* to the outer shell port 107 can remain in place. As can be appreciated the tubing can provide fluid communication between the sensor 112 and a well environment.

As shown generally in FIGS. 4A-4B, the vibratory motor 118 can be located proximate an interior wall of the first hemisphere 110*a*. As can be appreciated, the internal components of the measurement assembly 102 can be oriented in different configurations based on sizes of the various components. The vibratory motor 118 can generally be placed proximate an interior wall of the shell 110 to provide haptic feedback to a user.

Described hereinafter are dimensions for one example embodiment of the measurement assembly 102. The measurements listed are not meant to be limiting and are provided to show one example embodiment of the measurement assembly 102. It is to be appreciated that as a diameter of the shell 110 is increased, a thickness of the shell would need to be increased to provide adequate strength to withstand extreme pressures. The shell 110 may have an outside diameter of approximately 1½ inches (1.500 inches). The first hemisphere 110 *a* and the second hemisphere 110 *b* can each have a thickness of approximately 1/25 of an inch (0.04 inches). Of note, the second hemisphere 110 *b* may have a greater thickness for the portions forming the receptacle 111.

Typically, the sensor 112 can be calibrated prior to the modular fracking ball assembly 100 being introduced into a well. To overcome the issue of calibration for the sensor 112 of the measurement assembly 102, one or more means can be used to calibrate the sensor 112. Precision calibration of a pressure transducer is typically performed after the control module 114 has been operatively connected to the sensor 112. For example, a recording circuit and an analog-to-digital measurement can be mated to a pressure transducer. Once the sensor 112 is operatively connected to the control module 114, the measurement components may be coupled to the receptacle 111 of the second hemisphere 110*b*. As can be appreciated, calibration of a pressure transducer is particularly difficult to perform in the measurement assembly 102 after the measurement assembly 102 has been welded closed.

In a first means, the sensor 112 can be calibrated prior to the first hemisphere 110*a* being welded to the second hemisphere 110*b*. In one example where the port 111*a* is threaded, a high-pressure metal-to-metal fitting (the threaded port 111*a*) can be machined directly into the shell of the measurement assembly 102. The metal-to-metal fitting can provide a means to temporarily attach a high-pressure hydraulic tubing system directly from a pressure source to the measurement assembly 102. A variety of fixed pressure and temperature ranges can then be applied. Once calibration is completed, the tubing can be removed and the fitting may be either drilled out for maximum orifice size or simply left in place. Data related to the calibration can be stored in the control module 114 and/or ported to another computing device for later retrieval and use. Advantages of the aforementioned method include, but are not limited to, the ability to calibrate and functionally test the entire system prior to welding the shell together, the calibration can be verified, and there is no need for fluid chambers.

A second means can include placing a welded measurement assembly 102 into a calibration high-pressure chamber. Prior to a start of the calibration sequence, the control module 114 of the measurement assembly 102 can be set to continuously record data.

The measurement assembly 102 can be placed in the high-pressure chamber and a calibration fluid can be injected at a variety of fixed pressure and temperature ranges. Once the calibration sequence is complete, the control module 114 can be turned off (e.g., via a magnet and the reed switch) and can be ready to be used in a fracking operation. Once the measurement assembly 102 is retrieved from a well, the saved calibration data can be used to provide accurate data from measurements stored while the measurement assembly 102 was in the well.

Referring to FIG. 5, a perspective view of the modular fracking ball assembly 100 including grooves 150 is illustrated. The outer shell 106 may include the grooves 150 to help to position (or orient) the port 111*a* of the modular fracking ball assembly 100. Of note, the pressure port 111*a* of the measurement assembly 102 should be orientated correctly when the modular fracking ball assembly 100 is used as a plug sealing ball. A means to increase a probability of an orientation of the modular fracking ball assembly 100 is needed since there is only one port available. The grooves 150 can be implemented to provide a guide for flowing fluid (liquid or gas) to help orient the port 111*a*. In another instance, a preferentially weighted side of the outer shell 106 can be used to increase a probability of the pressure port 111*a* in a desired position. Either separately or together, these methods can be implemented to increase a probability of measuring the desired pressure.

Modifying a surface friction of the modular fracking ball assembly 100 can help the modular fracking ball assembly 100 flow back to surface especially with lower flowback production rates. In some instances, a surface of the outer shell 106 can include dimples (e.g., similar to a golf ball) or a roughed-up surface.

Figure 6:
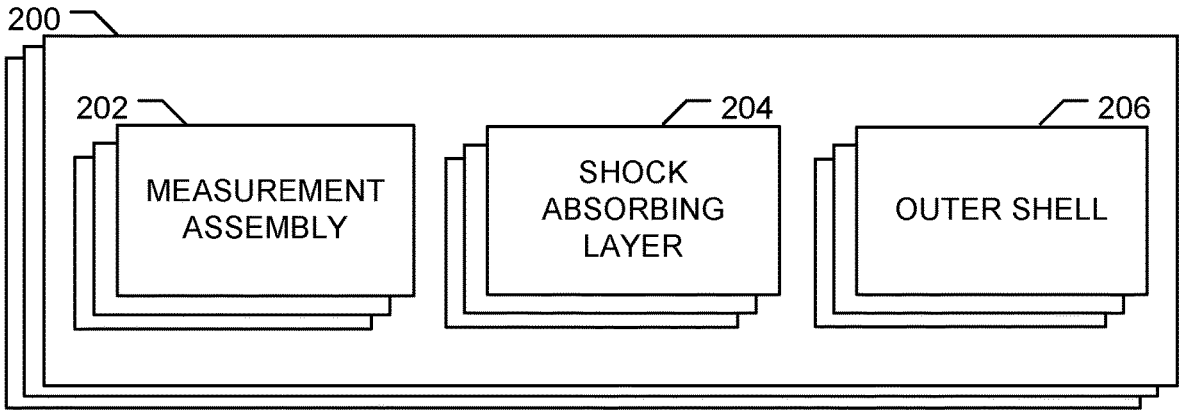
FIG. 6 is a block diagram of a modular fracking ball assembly system according to one embodiment of the present invention.

Referring to FIG. 6, a block diagram of an embodiment 200 of a kit or system of modular fracking ball assemblies is illustrated. The modular fracking ball assembly system 200 can be implemented to provide a variety of modular fracking ball assemblies having various sizes and specific gravities. The system 200 can further include modular fracking ball assemblies that may be assembled on-site at a well based on specific needs of said well.

In such an embodiment, a plurality of measurement assemblies 202, a plurality of shock absorbing layers 204, and a plurality of outer shells 206 can be provided. The measurement assemblies 202, the shock absorbing layers 204, and the outer shells 206 can be substantially similar to the previously described components 102, 104, 106. Typically, one of each of the components 202, 204, 206 can be assembled together to make a modular fracking ball assembly.

In one example, a method of implementing the system of modular fracking ball assemblies 200 can include one or more steps whereby a plurality of modular fracking ball assemblies are prepared for use in an oil and/or gas well. First, the plurality of measurement assemblies 202, the plurality of shock absorbing layers 204, and the plurality of outer shells 206 can be provided. In some instances, the shock absorbing layers 204 can be pre-molded to the measurement assemblies 202 such that they do not need to be attached. In other instances, the shock absorbing layers 204 can be secured to the measurement assemblies 202 in the field. Second, a first modular fracking ball assembly can be assembled. To prepare the first modular fracking ball to be assembled, one of the measurement assemblies 202 and one of the shock absorbing layers 204 can be picked out. Of note, where different shock absorbing layers are provided, an operator can select a shock absorbing layer based on needs of the modular fracking ball assembly in the well. Third, an outer shell can be picked out based on needs of a particular well. In some instances, a diameter and a specific gravity for the modular fracking ball assembly may be determined based on the outer shell selected. Once all three components are selected, an operator can put the components together to assemble the first modular fracking ball assembly. These steps can be repeated for each modular fracking ball assembly needing to be assembled. Of note, one or more of the modular fracking ball assemblies can have different parameters based on the outer shell selected during assembly.

Once all of the modular fracking ball assemblies are assembled, each of the modular fracking ball assemblies can be activated before being put into the well. To activate a modular fracking ball assembly, the control module can be turned on by activating the reed switch with a magnet located exterior to the modular fracking ball assembly. To confirm that the control module has been powered on, the vibratory motor can provide haptic feedback to the operator. After all of the modular fracking ball assemblies are activated, the assembled modular fracking ball assemblies can be ready to be inserted into a well operation.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A modular fracking ball assembly comprising:
- a measurement assembly, the measurement assembly including:
  - a shell having a substantially spherical shape with a first hemisphere coupled to a second hemisphere;
  - a pressure sensor located inside the shell;
  - a control module located inside the shell, the control module adapted to store measurements from the pressure sensor;
  - a vibratory motor located inside the shell, the vibratory motor adapted to provide haptic feedback; and
  - a switch located inside the shell, the switch adapted to turn the control module on and off; and
- an outer shell encasing the measurement assembly.

2. The modular fracking ball assembly of claim 1, wherein the shell is manufactured from a non-magnetic material.

3. The modular fracking ball assembly of claim 1, wherein the switch is a reed switch.

4. The modular fracking ball assembly of claim 1, wherein the first hemisphere is electron beam welded to the second hemisphere.

5. The modular fracking ball assembly of claim 1, wherein the outer shell includes a first hemisphere and a second hemisphere, the outer shell first hemisphere being removably coupled to the outer shell second hemisphere.

6. The modular fracking ball assembly of claim 1, wherein the second hemisphere includes a port proximate a location of the pressure sensor providing fluid communication to the pressure sensor.

7. The modular fracking ball assembly of claim 1, wherein the switch is activated from outside the shell of the measurement assembly.

8. The modular fracking ball assembly of claim 1, wherein the modular fracking ball assembly further includes a shock absorbing layer encasing the measurement assembly.

9. The modular fracking ball assembly of claim 1, wherein a specific gravity of the modular fracking ball assembly is partially determined by the outer shell.

10. The modular fracking ball assembly of claim 1, wherein the vibratory motor provides haptic feedback when the control module is turned on.

11. A method of implementing at least one modular fracking ball assembly, the method comprising:
- providing the at least one modular fracking ball assembly, the modular fracking ball assembly in a powered down state and including:
  - an outer shell;
  - a shock absorbing layer; and
  - a measurement assembly, the measurement assembly comprising:
    - a shell having a substantially spherical shape with a first hemisphere welded to a second hemisphere;
    - a pressure sensor located inside the shell;
    - a control module located inside the shell, the control module adapted to store measurements from the pressure sensor;
    - a vibratory motor located inside the shell, the vibratory motor adapted to provide haptic feedback; and
    - a reed switch located inside the shell, the switch adapted to turn the control module on and off;
- turning the control module on by activating the reed switch with a magnet located exterior to the modular fracking ball assembly;
- receiving haptic feedback from the vibratory motor indicating that the control module has been turned on; and
- preparing the modular fracking ball assembly for use in a well operation.

12. The method of claim 11, the method further including the steps of:
- selecting the outer shell based on a desired specific gravity for the modular fracking ball assembly; and
- encasing the measurement assembly and the shock absorbing layer with the outer shell.

13. The method of claim 11, wherein prior to providing the modular fracking ball assembly, the method includes the step of:

calibrating the pressure sensor.

14. The method of claim 11, the method further including the steps of:

recovering the modular fracking ball assembly from the well operation;

cutting the shell of the measurement assembly in half; and recovering data from the control module.

15. The method of claim 11, the method further including the step of:

selecting the outer shell based on a desired diameter for the modular fracking ball assembly.

16. The method of claim 11, the method further including the step of:

providing a second modular fracking ball assembly.

17. The method of claim 16, wherein an outer shell of the second modular fracking ball assembly has a different diameter than the outer shell of the first modular fracking ball assembly.

18. The method of claim 16, wherein an outer shell of the second modular fracking ball assembly has a different specific gravity than the outer shell of the first modular fracking ball assembly.

19. The method of claim 11, wherein the measurement assembly has an approximately 1.5 inch diameter.

20. A modular fracking ball assembly comprising:

a measurement assembly including:

a non-magnetic shell having a spherical shape, the shell having been formed from two hemispheres coupled together via an electron beam welding process;

a pressure sensor located inside the shell;

a control module located inside the shell, the control module adapted to store measurements from the pressure sensor;

a vibratory motor located inside the shell, the vibratory motor adapted to provide haptic feedback; and a switch located inside the shell, the switch adapted to turn the control module on and off;

a shock absorbing layer surrounding the measurement assembly; and an outer shell encasing the shock absorbing layer and the measurement assembly.

* * * * *